US007990342B2

(12) United States Patent
Yamada

(10) Patent No.: US 7,990,342 B2
(45) Date of Patent: Aug. 2, 2011

(54) IMAGE DISPLAY METHOD AND IMAGE DISPLAY DEVICE

(75) Inventor: Kazuhiro Yamada, Takatsuki (JP)

(73) Assignee: Panasonic Corporation (JP)

( * ) Notice: Subject to any disclaimer, the term of this patent is extended or adjusted under 35 U.S.C. 154(b) by 710 days.

(21) Appl. No.: 10/536,928

(22) PCT Filed: Oct. 1, 2004

(86) PCT No.: PCT/JP2004/014491

§ 371 (c)(1),
(2), (4) Date: May 31, 2005

(87) PCT Pub. No.: WO2005/036512

PCT Pub. Date: Apr. 21, 2005

(65) Prior Publication Data

US 2006/0033687 A1 Feb. 16, 2006

(30) Foreign Application Priority Data

Oct. 14, 2003 (JP) ..... 2003-353459

(51) Int. Cl.
*G09G 3/28* (2006.01)

(52) U.S. Cl. ..... 345/63; 345/60

(58) Field of Classification Search ..... 345/60, 345/63; 315/169.4

See application file for complete search history.

(56) References Cited

U.S. PATENT DOCUMENTS 6,473,464 B1 * 10/2002 Weitbruch et al. ..... 375/240.26
6,693,609 B2 * 2/2004 Lee et al. ..... 345/63
6,965,358 B1 * 11/2005 Kasahara et al. ..... 345/63
7,102,599 B2 * 9/2006 Okuzawa et al. ..... 345/63
2003/0011542 A1 * 1/2003 Nakamura ..... 345/63
2003/0052841 A1 * 3/2003 Tanaka et al. ..... 345/63

FOREIGN PATENT DOCUMENTS

JP 9-258689 A 10/1997
JP 2000-276100 A 10/2000
JP 2001-56665 A 2/2001

(Continued)

OTHER PUBLICATIONS

T. Masuda et al., "New Category Contour Noise Observed in Pulse-Width-Modulated Moving Images", The Institute of Television Engineers of Japan Technical Report, vol. 19, No. 2, IDY95-21, pp. 61-66. (English Abstract provided), Jun. 21, 2007.

(Continued)

*Primary Examiner* — Quan-Zhen Wang
*Assistant Examiner* — Calvin C Ma
(74) *Attorney, Agent, or Firm* — Rossi, Kimms & McDowell LLP

(57) ABSTRACT

The present invention provides an image display method that allows displaying a full range of gradation levels while reducing dynamic false contours. In this method, emission pattern information generation circuit in image display device that displays gradation by dividing a single field into a plurality of subfields and combining an emitted state and a non-emitted state for each subfield, generates plural pieces of emission pattern information so that an average emission rate becomes a given value or greater for any subfield with its brightness weight smaller than the maximum brightness weight of the subfield where its average emission rate is not zero. Further, dither generation circuit in image display device performs a time-averaging process and a space-averaging process for the plurality of pieces of emission pattern information.

12 Claims, 21 Drawing Sheets

FOREIGN PATENT DOCUMENTS

| | | | |
|---|---|---|---|
| JP | 3322809 | B2 | 6/2002 |
| JP | 2002-304147 | A | 10/2002 |
| JP | 2003-15588 | A | 1/2003 |
| JP | 2003-66892 | A | 3/2003 |

OTHER PUBLICATIONS

Relevant portion of International Search Report of PCT/JP2004/014491, Jan. 10, 2004.

* cited by examiner

FIG. 1

| | Subfield | SF1 | SF 2 | SF 3 | SF 4 | SF 5 | S F6 | SF 7 | SF 8 | SF 9 | SF 10 |
|---|---|---|---|---|---|---|---|---|---|---|---|
| | Weight of Gradation level | 1 | 2 | 4 | 8 | 12 | 16 | 28 | 44 | 60 | 80 |
| Gradation table for gradation level "165" | | 1 | 1 | 1 | 1 | 0.75 | 1 | 0.75 | 1 | 1 | 0 |
| Emission pattern information for gradation level "165" | S1(175) | 1 | 1 | 1 | 1 | 1 | 1 | 1 | 1 | 1 | 0 |
| | S2(175) | 1 | 1 | 1 | 1 | 1 | 1 | 1 | 1 | 1 | 0 |
| | S3(147) | 1 | 1 | 1 | 1 | 1 | 1 | 0 | 1 | 1 | 0 |
| | S4(163) | 1 | 1 | 1 | 1 | 0 | 1 | 1 | 1 | 1 | 0 |

Values in parentheses are gradation levels shown by emission pattern information itself.

FIG. 2

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 0 | 0 | 0 | 0 | 0 | 0 | 0 | 0 | 0 | 0 | 0 |
| 1 | 1 | 0 | 0 | 0 | 0 | 0 | 0 | 0 | 0 | 0 |
| 2 | 1 | 0.5 | 0 | 0 | 0 | 0 | 0 | 0 | 0 | 0 |
| 3 | 1 | 1 | 0 | 0 | 0 | 0 | 0 | 0 | 0 | 0 |
| 4 | 1 | 1 | 0.25 | 0 | 0 | 0 | 0 | 0 | 0 | 0 |
| 5 | 1 | 1 | 0.5 | 0 | 0 | 0 | 0 | 0 | 0 | 0 |
| 6 | 1 | 1 | 0.75 | 0 | 0 | 0 | 0 | 0 | 0 | 0 |
| 7 | 1 | 1 | 1 | 0 | 0 | 0 | 0 | 0 | 0 | 0 |
| 8 | 1 | 1 | 0.75 | 0.25 | 0 | 0 | 0 | 0 | 0 | 0 |
| 9 | 1 | 1 | 1 | 0.25 | 0 | 0 | 0 | 0 | 0 | 0 |
| 10 | 1 | 1 | 0.75 | 0.5 | 0 | 0 | 0 | 0 | 0 | 0 |
| 11 | 1 | 1 | 1 | 0.5 | 0 | 0 | 0 | 0 | 0 | 0 |
| 12 | 1 | 1 | 0.75 | 0.75 | 0 | 0 | 0 | 0 | 0 | 0 |
| 13 | 1 | 1 | 1 | 0.75 | 0 | 0 | 0 | 0 | 0 | 0 |
| 14 | 1 | 1 | 0.75 | 1 | 0 | 0 | 0 | 0 | 0 | 0 |
| 15 | 1 | 1 | 1 | 1 | 0 | 0 | 0 | 0 | 0 | 0 |
| 16 | 1 | 1 | 1 | 0.75 | 0.25 | 0 | 0 | 0 | 0 | 0 |
| 17 | 1 | 1 | 0.75 | 1 | 0.25 | 0 | 0 | 0 | 0 | 0 |
| 18 | 1 | 1 | 1 | 1 | 0.25 | 0 | 0 | 0 | 0 | 0 |
| 19 | 1 | 1 | 1 | 0.75 | 0.5 | 0 | 0 | 0 | 0 | 0 |
| 20 | 1 | 1 | 0.75 | 1 | 0.5 | 0 | 0 | 0 | 0 | 0 |
| 21 | 1 | 1 | 1 | 1 | 0.5 | 0 | 0 | 0 | 0 | 0 |
| 22 | 1 | 1 | 1 | 0.75 | 0.75 | 0 | 0 | 0 | 0 | 0 |
| 23 | 1 | 1 | 0.75 | 1 | 0.75 | 0 | 0 | 0 | 0 | 0 |
| 24 | 1 | 1 | 1 | 1 | 0.75 | 0 | 0 | 0 | 0 | 0 |
| 25 | 1 | 1 | 1 | 0.75 | 1 | 0 | 0 | 0 | 0 | 0 |
| 26 | 1 | 1 | 0.75 | 1 | 1 | 0 | 0 | 0 | 0 | 0 |
| 27 | 1 | 1 | 1 | 1 | 1 | 0 | 0 | 0 | 0 | 0 |
| 28 | 1 | 1 | 1 | 1 | 0.75 | 0.25 | 0 | 0 | 0 | 0 |
| 29 | 1 | 1 | 1 | 0.75 | 1 | 0.25 | 0 | 0 | 0 | 0 |

FIG. 3

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 30 | 1 | 1 | 0.75 | 1 | 1 | 0.25 | 0 | 0 | 0 | 0 |
| 31 | 1 | 1 | 1 | 1 | 1 | 0.25 | 0 | 0 | 0 | 0 |
| 32 | 1 | 1 | 1 | 1 | 0.75 | 0.5 | 0 | 0 | 0 | 0 |
| 33 | 1 | 1 | 1 | 0.75 | 1 | 0.5 | 0 | 0 | 0 | 0 |
| 34 | 1 | 1 | 0.75 | 1 | 1 | 0.5 | 0 | 0 | 0 | 0 |
| 35 | 1 | 1 | 1 | 1 | 1 | 0.5 | 0 | 0 | 0 | 0 |
| 36 | 1 | 1 | 1 | 1 | 0.75 | 0.75 | 0 | 0 | 0 | 0 |
| 37 | 1 | 1 | 1 | 0.75 | 1 | 0.75 | 0 | 0 | 0 | 0 |
| 38 | 1 | 1 | 0.75 | 1 | 1 | 0.75 | 0 | 0 | 0 | 0 |
| 39 | 1 | 1 | 1 | 1 | 1 | 0.75 | 0 | 0 | 0 | 0 |
| 40 | 1 | 1 | 1 | 1 | 0.75 | 1 | 0 | 0 | 0 | 0 |
| 41 | 1 | 1 | 1 | 0.75 | 1 | 1 | 0 | 0 | 0 | 0 |
| 42 | 1 | 1 | 0.75 | 1 | 1 | 1 | 0 | 0 | 0 | 0 |
| 43 | 1 | 1 | 1 | 1 | 1 | 1 | 0 | 0 | 0 | 0 |
| 44 | 1 | 1 | 1 | 0.75 | 1 | 0.75 | 0.25 | 0 | 0 | 0 |
| 45 | 1 | 1 | 0.75 | 1 | 1 | 0.75 | 0.25 | 0 | 0 | 0 |
| 46 | 1 | 1 | 1 | 1 | 1 | 0.75 | 0.25 | 0 | 0 | 0 |
| 47 | 1 | 1 | 1 | 1 | 0.75 | 1 | 0.25 | 0 | 0 | 0 |
| 48 | 1 | 1 | 1 | 0.75 | 1 | 1 | 0.25 | 0 | 0 | 0 |
| 49 | 1 | 1 | 0.75 | 1 | 1 | 1 | 0.25 | 0 | 0 | 0 |
| 50 | 1 | 1 | 1 | 1 | 1 | 1 | 0.25 | 0 | 0 | 0 |
| 51 | 1 | 1 | 1 | 0.75 | 1 | 0.75 | 0.5 | 0 | 0 | 0 |
| 52 | 1 | 1 | 0.75 | 1 | 1 | 0.75 | 0.5 | 0 | 0 | 0 |
| 53 | 1 | 1 | 1 | 1 | 1 | 0.75 | 0.5 | 0 | 0 | 0 |
| 54 | 1 | 1 | 1 | 1 | 0.75 | 1 | 0.5 | 0 | 0 | 0 |
| 55 | 1 | 1 | 1 | 0.75 | 1 | 1 | 0.5 | 0 | 0 | 0 |
| 56 | 1 | 1 | 0.75 | 1 | 1 | 1 | 0.5 | 0 | 0 | 0 |
| 57 | 1 | 1 | 1 | 1 | 1 | 1 | 0.5 | 0 | 0 | 0 |
| 58 | 1 | 1 | 1 | 0.75 | 1 | 0.75 | 0.75 | 0 | 0 | 0 |
| 59 | 1 | 1 | 0.75 | 1 | 1 | 0.75 | 0.75 | 0 | 0 | 0 |

FIG. 4

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 60 | 1 | 1 | 1 | 1 | 1 | 0.75 | 0.75 | 0 | 0 | 0 |
| 61 | 1 | 1 | 1 | 1 | 0.75 | 1 | 0.75 | 0 | 0 | 0 |
| 62 | 1 | 1 | 1 | 0.75 | 1 | 1 | 0.75 | 0 | 0 | 0 |
| 63 | 1 | 1 | 0.75 | 1 | 1 | 1 | 0.75 | 0 | 0 | 0 |
| 64 | 1 | 1 | 1 | 1 | 1 | 1 | 0.75 | 0 | 0 | 0 |
| 65 | 1 | 1 | 1 | 0.75 | 1 | 0.75 | 1 | 0 | 0 | 0 |
| 66 | 1 | 1 | 0.75 | 1 | 1 | 0.75 | 1 | 0 | 0 | 0 |
| 67 | 1 | 1 | 1 | 1 | 1 | 0.75 | 1 | 0 | 0 | 0 |
| 68 | 1 | 1 | 1 | 1 | 0.75 | 1 | 1 | 0 | 0 | 0 |
| 69 | 1 | 1 | 1 | 0.75 | 1 | 1 | 1 | 0 | 0 | 0 |
| 70 | 1 | 1 | 0.75 | 1 | 1 | 1 | 1 | 0 | 0 | 0 |
| 71 | 1 | 1 | 1 | 1 | 1 | 1 | 1 | 0 | 0 | 0 |
| 72 | 1 | 1 | 1 | 1 | 0.75 | 1 | 0.75 | 0.25 | 0 | 0 |
| 73 | 1 | 1 | 1 | 0.75 | 1 | 1 | 0.75 | 0.25 | 0 | 0 |
| 74 | 1 | 1 | 0.75 | 1 | 1 | 1 | 0.75 | 0.25 | 0 | 0 |
| 75 | 1 | 1 | 1 | 1 | 1 | 1 | 0.75 | 0.25 | 0 | 0 |
| 76 | 1 | 1 | 1 | 0.75 | 1 | 0.75 | 1 | 0.25 | 0 | 0 |
| 77 | 1 | 1 | 0.75 | 1 | 1 | 0.75 | 1 | 0.25 | 0 | 0 |
| 78 | 1 | 1 | 1 | 1 | 1 | 0.75 | 1 | 0.25 | 0 | 0 |
| 79 | 1 | 1 | 1 | 1 | 0.75 | 1 | 1 | 0.25 | 0 | 0 |
| 80 | 1 | 1 | 1 | 0.75 | 1 | 1 | 1 | 0.25 | 0 | 0 |
| 81 | 1 | 1 | 0.75 | 1 | 1 | 1 | 1 | 0.25 | 0 | 0 |
| 82 | 1 | 1 | 1 | 1 | 1 | 1 | 1 | 0.25 | 0 | 0 |
| 83 | 1 | 1 | 1 | 1 | 0.75 | 1 | 0.75 | 0.5 | 0 | 0 |
| 84 | 1 | 1 | 1 | 0.75 | 1 | 1 | 0.75 | 0.5 | 0 | 0 |
| 85 | 1 | 1 | 0.75 | 1 | 1 | 1 | 0.75 | 0.5 | 0 | 0 |
| 86 | 1 | 1 | 1 | 1 | 1 | 1 | 0.75 | 0.5 | 0 | 0 |
| 87 | 1 | 1 | 1 | 0.75 | 1 | 0.75 | 1 | 0.5 | 0 | 0 |
| 88 | 1 | 1 | 0.75 | 1 | 1 | 0.75 | 1 | 0.5 | 0 | 0 |
| 89 | 1 | 1 | 1 | 1 | 1 | 0.75 | 1 | 0.5 | 0 | 0 |

FIG. 5

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 90 | 1 | 1 | 1 | 1 | 0.75 | 1 | 1 | 0.5 | 0 | 0 |
| 91 | 1 | 1 | 1 | 0.75 | 1 | 1 | 1 | 0.5 | 0 | 0 |
| 92 | 1 | 1 | 0.75 | 1 | 1 | 1 | 1 | 0.5 | 0 | 0 |
| 93 | 1 | 1 | 1 | 1 | 1 | 1 | 1 | 0.5 | 0 | 0 |
| 94 | 1 | 1 | 1 | 1 | 0.75 | 1 | 0.75 | 0.75 | 0 | 0 |
| 95 | 1 | 1 | 1 | 0.75 | 1 | 1 | 0.75 | 0.75 | 0 | 0 |
| 96 | 1 | 1 | 0.75 | 1 | 1 | 1 | 0.75 | 0.75 | 0 | 0 |
| 97 | 1 | 1 | 1 | 1 | 1 | 1 | 0.75 | 0.75 | 0 | 0 |
| 98 | 1 | 1 | 1 | 0.75 | 1 | 0.75 | 1 | 0.75 | 0 | 0 |
| 99 | 1 | 1 | 0.75 | 1 | 1 | 0.75 | 1 | 0.75 | 0 | 0 |
| 100 | 1 | 1 | 1 | 1 | 1 | 0.75 | 1 | 0.75 | 0 | 0 |
| 101 | 1 | 1 | 1 | 1 | 0.75 | 1 | 1 | 0.75 | 0 | 0 |
| 102 | 1 | 1 | 1 | 0.75 | 1 | 1 | 1 | 0.75 | 0 | 0 |
| 103 | 1 | 1 | 0.75 | 1 | 1 | 1 | 1 | 0.75 | 0 | 0 |
| 104 | 1 | 1 | 1 | 1 | 1 | 1 | 1 | 0.75 | 0 | 0 |
| 105 | 1 | 1 | 1 | 1 | 0.75 | 1 | 0.75 | 1 | 0 | 0 |
| 106 | 1 | 1 | 1 | 0.75 | 1 | 1 | 0.75 | 1 | 0 | 0 |
| 107 | 1 | 1 | 0.75 | 1 | 1 | 1 | 0.75 | 1 | 0 | 0 |
| 108 | 1 | 1 | 1 | 1 | 1 | 1 | 0.75 | 1 | 0 | 0 |
| 109 | 1 | 1 | 1 | 0.75 | 1 | 0.75 | 1 | 1 | 0 | 0 |
| 110 | 1 | 1 | 0.75 | 1 | 1 | 0.75 | 1 | 1 | 0 | 0 |
| 111 | 1 | 1 | 1 | 1 | 1 | 0.75 | 1 | 1 | 0 | 0 |
| 112 | 1 | 1 | 1 | 1 | 0.75 | 1 | 1 | 1 | 0 | 0 |
| 113 | 1 | 1 | 1 | 0.75 | 1 | 1 | 1 | 1 | 0 | 0 |
| 114 | 1 | 1 | 0.75 | 1 | 1 | 1 | 1 | 1 | 0 | 0 |
| 115 | 1 | 1 | 1 | 1 | 1 | 1 | 1 | 1 | 0 | 0 |
| 116 | 1 | 1 | 1 | 1 | 0.75 | 1 | 1 | 0.75 | 0.25 | 0 |
| 117 | 1 | 1 | 1 | 0.75 | 1 | 1 | 1 | 0.75 | 0.25 | 0 |
| 118 | 1 | 1 | 0.75 | 1 | 1 | 1 | 1 | 0.75 | 0.25 | 0 |
| 119 | 1 | 1 | 1 | 1 | 1 | 1 | 1 | 0.75 | 0.25 | 0 |

FIG. 6

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 120 | 1 | 1 | 1 | 1 | 0.75 | 1 | 0.75 | 1 | 0.25 | 0 |
| 121 | 1 | 1 | 1 | 0.75 | 1 | 1 | 0.75 | 1 | 0.25 | 0 |
| 122 | 1 | 1 | 0.75 | 1 | 1 | 1 | 0.75 | 1 | 0.25 | 0 |
| 123 | 1 | 1 | 1 | 1 | 1 | 1 | 0.75 | 1 | 0.25 | 0 |
| 124 | 1 | 1 | 1 | 0.75 | 1 | 0.75 | 1 | 1 | 0.25 | 0 |
| 125 | 1 | 1 | 0.75 | 1 | 1 | 0.75 | 1 | 1 | 0.25 | 0 |
| 126 | 1 | 1 | 1 | 1 | 1 | 0.75 | 1 | 1 | 0.25 | 0 |
| 127 | 1 | 1 | 1 | 1 | 0.75 | 1 | 1 | 1 | 0.25 | 0 |
| 128 | 1 | 1 | 1 | 0.75 | 1 | 1 | 1 | 1 | 0.25 | 0 |
| 129 | 1 | 1 | 0.75 | 1 | 1 | 1 | 1 | 1 | 0.25 | 0 |
| 130 | 1 | 1 | 1 | 1 | 1 | 1 | 1 | 1 | 0.25 | 0 |
| 131 | 1 | 1 | 1 | 1 | 0.75 | 1 | 1 | 0.75 | 0.5 | 0 |
| 132 | 1 | 1 | 1 | 0.75 | 1 | 1 | 1 | 0.75 | 0.5 | 0 |
| 133 | 1 | 1 | 0.75 | 1 | 1 | 1 | 1 | 0.75 | 0.5 | 0 |
| 134 | 1 | 1 | 1 | 1 | 1 | 1 | 1 | 0.75 | 0.5 | 0 |
| 135 | 1 | 1 | 1 | 1 | 0.75 | 1 | 0.75 | 1 | 0.5 | 0 |
| 136 | 1 | 1 | 1 | 0.75 | 1 | 1 | 0.75 | 1 | 0.5 | 0 |
| 137 | 1 | 1 | 0.75 | 1 | 1 | 1 | 0.75 | 1 | 0.5 | 0 |
| 138 | 1 | 1 | 1 | 1 | 1 | 1 | 0.75 | 1 | 0.5 | 0 |
| 139 | 1 | 1 | 1 | 0.75 | 1 | 0.75 | 1 | 1 | 0.5 | 0 |
| 140 | 1 | 1 | 0.75 | 1 | 1 | 0.75 | 1 | 1 | 0.5 | 0 |
| 141 | 1 | 1 | 1 | 1 | 1 | 0.75 | 1 | 1 | 0.5 | 0 |
| 142 | 1 | 1 | 1 | 1 | 0.75 | 1 | 1 | 1 | 0.5 | 0 |
| 143 | 1 | 1 | 1 | 0.75 | 1 | 1 | 1 | 1 | 0.5 | 0 |
| 144 | 1 | 1 | 0.75 | 1 | 1 | 1 | 1 | 1 | 0.5 | 0 |
| 145 | 1 | 1 | 1 | 1 | 1 | 1 | 1 | 1 | 0.5 | 0 |
| 146 | 1 | 1 | 1 | 1 | 0.75 | 1 | 1 | 0.75 | 0.75 | 0 |
| 147 | 1 | 1 | 1 | 0.75 | 1 | 1 | 1 | 0.75 | 0.75 | 0 |
| 148 | 1 | 1 | 0.75 | 1 | 1 | 1 | 1 | 0.75 | 0.75 | 0 |
| 149 | 1 | 1 | 1 | 1 | 1 | 1 | 1 | 0.75 | 0.75 | 0 |

FIG. 7

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 150 | 1 | 1 | 1 | 1 | 0.75 | 1 | 0.75 | 1 | 0.75 | 0 |
| 151 | 1 | 1 | 1 | 0.75 | 1 | 1 | 0.75 | 1 | 0.75 | 0 |
| 152 | 1 | 1 | 0.75 | 1 | 1 | 1 | 0.75 | 1 | 0.75 | 0 |
| 153 | 1 | 1 | 1 | 1 | 1 | 1 | 0.75 | 1 | 0.75 | 0 |
| 154 | 1 | 1 | 1 | 0.75 | 1 | 0.75 | 1 | 1 | 0.75 | 0 |
| 155 | 1 | 1 | 0.75 | 1 | 1 | 0.75 | 1 | 1 | 0.75 | 0 |
| 156 | 1 | 1 | 1 | 1 | 1 | 0.75 | 1 | 1 | 0.75 | 0 |
| 157 | 1 | 1 | 1 | 1 | 0.75 | 1 | 1 | 1 | 0.75 | 0 |
| 158 | 1 | 1 | 1 | 0.75 | 1 | 1 | 1 | 1 | 0.75 | 0 |
| 159 | 1 | 1 | 0.75 | 1 | 1 | 1 | 1 | 1 | 0.75 | 0 |
| 160 | 1 | 1 | 1 | 1 | 1 | 1 | 1 | 1 | 0.75 | 0 |
| 161 | 1 | 1 | 1 | 1 | 0.75 | 1 | 1 | 0.75 | 1 | 0 |
| 162 | 1 | 1 | 1 | 0.75 | 1 | 1 | 1 | 0.75 | 1 | 0 |
| 163 | 1 | 1 | 0.75 | 1 | 1 | 1 | 1 | 0.75 | 1 | 0 |
| 164 | 1 | 1 | 1 | 1 | 1 | 1 | 1 | 0.75 | 1 | 0 |
| 165 | 1 | 1 | 1 | 1 | 0.75 | 1 | 0.75 | 1 | 1 | 0 |
| 166 | 1 | 1 | 1 | 0.75 | 1 | 1 | 0.75 | 1 | 1 | 0 |
| 167 | 1 | 1 | 0.75 | 1 | 1 | 1 | 0.75 | 1 | 1 | 0 |
| 168 | 1 | 1 | 1 | 1 | 1 | 1 | 0.75 | 1 | 1 | 0 |
| 169 | 1 | 1 | 1 | 0.75 | 1 | 0.75 | 1 | 1 | 1 | 0 |
| 170 | 1 | 1 | 0.75 | 1 | 1 | 0.75 | 1 | 1 | 1 | 0 |
| 171 | 1 | 1 | 1 | 1 | 1 | 0.75 | 1 | 1 | 1 | 0 |
| 172 | 1 | 1 | 1 | 1 | 0.75 | 1 | 1 | 1 | 1 | 0 |
| 173 | 1 | 1 | 1 | 0.75 | 1 | 1 | 1 | 1 | 1 | 0 |
| 174 | 1 | 1 | 0.75 | 1 | 1 | 1 | 1 | 1 | 1 | 0 |
| 175 | 1 | 1 | 1 | 1 | 1 | 1 | 1 | 1 | 1 | 0 |
| 176 | 1 | 1 | 1 | 1 | 1 | 0.75 | 1 | 1 | 0.75 | 0.25 |
| 177 | 1 | 1 | 1 | 1 | 0.75 | 1 | 1 | 1 | 0.75 | 0.25 |
| 178 | 1 | 1 | 1 | 0.75 | 1 | 1 | 1 | 1 | 0.75 | 0.25 |
| 179 | 1 | 1 | 0.75 | 1 | 1 | 1 | 1 | 1 | 0.75 | 0.25 |

FIG. 8

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 180 | 1 | 1 | 1 | 1 | 1 | 1 | 1 | 1 | 0.75 | 0.25 |
| 181 | 1 | 1 | 1 | 1 | 0.75 | 1 | 1 | 0.75 | 1 | 0.25 |
| 182 | 1 | 1 | 1 | 0.75 | 1 | 1 | 1 | 0.75 | 1 | 0.25 |
| 183 | 1 | 1 | 0.75 | 1 | 1 | 1 | 1 | 0.75 | 1 | 0.25 |
| 184 | 1 | 1 | 1 | 1 | 1 | 1 | 1 | 0.75 | 1 | 0.25 |
| 185 | 1 | 1 | 1 | 1 | 0.75 | 1 | 0.75 | 1 | 1 | 0.25 |
| 186 | 1 | 1 | 1 | 0.75 | 1 | 1 | 0.75 | 1 | 1 | 0.25 |
| 187 | 1 | 1 | 0.75 | 1 | 1 | 1 | 0.75 | 1 | 1 | 0.25 |
| 188 | 1 | 1 | 1 | 1 | 1 | 1 | 0.75 | 1 | 1 | 0.25 |
| 189 | 1 | 1 | 1 | 0.75 | 1 | 0.75 | 1 | 1 | 1 | 0.25 |
| 190 | 1 | 1 | 0.75 | 1 | 1 | 0.75 | 1 | 1 | 1 | 0.25 |
| 191 | 1 | 1 | 1 | 1 | 1 | 0.75 | 1 | 1 | 1 | 0.25 |
| 192 | 1 | 1 | 1 | 1 | 0.75 | 1 | 1 | 1 | 1 | 0.25 |
| 193 | 1 | 1 | 1 | 0.75 | 1 | 1 | 1 | 1 | 1 | 0.25 |
| 194 | 1 | 1 | 0.75 | 1 | 1 | 1 | 1 | 1 | 1 | 0.25 |
| 195 | 1 | 1 | 1 | 1 | 1 | 1 | 1 | 1 | 1 | 0.25 |
| 196 | 1 | 1 | 1 | 1 | 1 | 0.75 | 1 | 1 | 0.75 | 0.5 |
| 197 | 1 | 1 | 1 | 1 | 0.75 | 1 | 1 | 1 | 0.75 | 0.5 |
| 198 | 1 | 1 | 1 | 0.75 | 1 | 1 | 1 | 1 | 0.75 | 0.5 |
| 199 | 1 | 1 | 0.75 | 1 | 1 | 1 | 1 | 1 | 0.75 | 0.5 |
| 200 | 1 | 1 | 1 | 1 | 1 | 1 | 1 | 1 | 0.75 | 0.5 |
| 201 | 1 | 1 | 1 | 1 | 0.75 | 1 | 1 | 0.75 | 1 | 0.5 |
| 202 | 1 | 1 | 1 | 0.75 | 1 | 1 | 1 | 0.75 | 1 | 0.5 |
| 203 | 1 | 1 | 0.75 | 1 | 1 | 1 | 1 | 0.75 | 1 | 0.5 |
| 204 | 1 | 1 | 1 | 1 | 1 | 1 | 1 | 0.75 | 1 | 0.5 |
| 205 | 1 | 1 | 1 | 1 | 0.75 | 1 | 0.75 | 1 | 1 | 0.5 |
| 206 | 1 | 1 | 1 | 0.75 | 1 | 1 | 0.75 | 1 | 1 | 0.5 |
| 207 | 1 | 1 | 0.75 | 1 | 1 | 1 | 0.75 | 1 | 1 | 0.5 |
| 208 | 1 | 1 | 1 | 1 | 1 | 1 | 0.75 | 1 | 1 | 0.5 |
| 209 | 1 | 1 | 1 | 0.75 | 1 | 0.75 | 1 | 1 | 1 | 0.5 |

FIG. 9

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 210 | 1 | 1 | 0.75 | 1 | 1 | 0.75 | 1 | 1 | 1 | 0.5 |
| 211 | 1 | 1 | 1 | 1 | 1 | 0.75 | 1 | 1 | 1 | 0.5 |
| 212 | 1 | 1 | 1 | 1 | 0.75 | 1 | 1 | 1 | 1 | 0.5 |
| 213 | 1 | 1 | 1 | 0.75 | 1 | 1 | 1 | 1 | 1 | 0.5 |
| 214 | 1 | 1 | 0.75 | 1 | 1 | 1 | 1 | 1 | 1 | 0.5 |
| 215 | 1 | 1 | 1 | 1 | 1 | 1 | 1 | 1 | 1 | 0.5 |
| 216 | 1 | 1 | 1 | 1 | 1 | 0.75 | 1 | 1 | 0.75 | 0.75 |
| 217 | 1 | 1 | 1 | 1 | 0.75 | 1 | 1 | 1 | 0.75 | 0.75 |
| 218 | 1 | 1 | 1 | 0.75 | 1 | 1 | 1 | 1 | 0.75 | 0.75 |
| 219 | 1 | 1 | 0.75 | 1 | 1 | 1 | 1 | 1 | 0.75 | 0.75 |
| 220 | 1 | 1 | 1 | 1 | 1 | 1 | 1 | 1 | 0.75 | 0.75 |
| 221 | 1 | 1 | 1 | 1 | 0.75 | 1 | 1 | 0.75 | 1 | 0.75 |
| 222 | 1 | 1 | 1 | 0.75 | 1 | 1 | 1 | 0.75 | 1 | 0.75 |
| 223 | 1 | 1 | 0.75 | 1 | 1 | 1 | 1 | 0.75 | 1 | 0.75 |
| 224 | 1 | 1 | 1 | 1 | 1 | 1 | 1 | 0.75 | 1 | 0.75 |
| 225 | 1 | 1 | 1 | 1 | 0.75 | 1 | 0.75 | 1 | 1 | 0.75 |
| 226 | 1 | 1 | 1 | 0.75 | 1 | 1 | 0.75 | 1 | 1 | 0.75 |
| 227 | 1 | 1 | 0.75 | 1 | 1 | 1 | 0.75 | 1 | 1 | 0.75 |
| 228 | 1 | 1 | 1 | 1 | 1 | 1 | 0.75 | 1 | 1 | 0.75 |
| 229 | 1 | 1 | 1 | 0.75 | 1 | 0.75 | 1 | 1 | 1 | 0.75 |
| 230 | 1 | 1 | 0.75 | 1 | 1 | 0.75 | 1 | 1 | 1 | 0.75 |
| 231 | 1 | 1 | 1 | 1 | 1 | 0.75 | 1 | 1 | 1 | 0.75 |
| 232 | 1 | 1 | 1 | 1 | 0.75 | 1 | 1 | 1 | 1 | 0.75 |
| 233 | 1 | 1 | 1 | 0.75 | 1 | 1 | 1 | 1 | 1 | 0.75 |
| 234 | 1 | 1 | 0.75 | 1 | 1 | 1 | 1 | 1 | 1 | 0.75 |
| 235 | 1 | 1 | 1 | 1 | 1 | 1 | 1 | 1 | 1 | 0.75 |
| 236 | 1 | 1 | 1 | 1 | 1 | 0.75 | 1 | 1 | 0.75 | 1 |
| 237 | 1 | 1 | 1 | 1 | 0.75 | 1 | 1 | 1 | 0.75 | 1 |
| 238 | 1 | 1 | 1 | 0.75 | 1 | 1 | 1 | 1 | 0.75 | 1 |
| 239 | 1 | 1 | 0.75 | 1 | 1 | 1 | 1 | 1 | 0.75 | 1 |

FIG. 10

| Gradation level to be displayed | Subfield | | | | | | | | | |
|---|---|---|---|---|---|---|---|---|---|---|
| | 1 | 2 | 3 | 4 | 5 | 6 | 7 | 8 | 9 | 10 |
| | 1 | 2 | 4 | 8 | 12 | 16 | 28 | 44 | 60 | 80 |
| 240 | 1 | 1 | 1 | 1 | 1 | 1 | 1 | 1 | 0.75 | 1 |
| 241 | 1 | 1 | 1 | 1 | 0.75 | 1 | 1 | 0.75 | 1 | 1 |
| 242 | 1 | 1 | 1 | 0.75 | 1 | 1 | 1 | 0.75 | 1 | 1 |
| 243 | 1 | 1 | 0.75 | 1 | 1 | 1 | 1 | 0.75 | 1 | 1 |
| 244 | 1 | 1 | 1 | 1 | 1 | 1 | 1 | 0.75 | 1 | 1 |
| 245 | 1 | 1 | 1 | 1 | 0.75 | 1 | 0.75 | 1 | 1 | 1 |
| 246 | 1 | 1 | 1 | 0.75 | 1 | 1 | 0.75 | 1 | 1 | 1 |
| 247 | 1 | 1 | 0.75 | 1 | 1 | 1 | 0.75 | 1 | 1 | 1 |
| 248 | 1 | 1 | 1 | 1 | 1 | 1 | 0.75 | 1 | 1 | 1 |
| 249 | 1 | 1 | 1 | 0.75 | 1 | 0.75 | 1 | 1 | 1 | 1 |
| 250 | 1 | 1 | 0.75 | 1 | 1 | 0.75 | 1 | 1 | 1 | 1 |
| 251 | 1 | 1 | 1 | 1 | 1 | 0.75 | 1 | 1 | 1 | 1 |
| 252 | 1 | 1 | 1 | 1 | 0.75 | 1 | 1 | 1 | 1 | 1 |
| 253 | 1 | 1 | 1 | 0.75 | 1 | 1 | 1 | 1 | 1 | 1 |
| 254 | 1 | 1 | 0.75 | 1 | 1 | 1 | 1 | 1 | 1 | 1 |
| 255 | 1 | 1 | 1 | 1 | 1 | 1 | 1 | 1 | 1 | 1 |

FIG. 11A

| | |
|---|---|
| A1 | A2 |
| A3 | A4 |

FIG. 11B

| | | | | | | | | | |
|---|---|---|---|---|---|---|---|---|---|
| A1 | A2 | A1 | A2 | A1 | A2 | A1 | A2 | A1 | A2 |
| A3 | A4 | A3 | A4 | A3 | A4 | A3 | A4 | A3 | A4 |
| A1 | A2 | A1 | A2 | A1 | A2 | A1 | A2 | A1 | A2 |
| A3 | A4 | A3 | A4 | A3 | A4 | A3 | A4 | A3 | A4 |
| A1 | A2 | A1 | A2 | A1 | A2 | A1 | A2 | A1 | A2 |
| A3 | A4 | A3 | A4 | A3 | A4 | A3 | A4 | A3 | A4 |
| A1 | A2 | A1 | A2 | A1 | A2 | A1 | A2 | A1 | A2 |
| A3 | A4 | A3 | A4 | A3 | A4 | A3 | A4 | A3 | A4 |

FIG. 13

| | Subfield | SF 1 | SF 2 | SF 3 | SF 4 | SF 5 | SF 6 | SF 7 | SF 8 | SF 9 | SF 10 |
|---|---|---|---|---|---|---|---|---|---|---|---|
| | Weight of gradation level | 1 | 2 | 4 | 8 | 12 | 16 | 28 | 44 | 60 | 80 |
| Gradation table for gradation level "240" | | 1 | 1 | 1 | 1 | 1 | 1 | 1 | 1 | 0.75 | 1 |
| Emission pattern information for gradation level "240" | S1 | 1 | 1 | 1 | 1 | 1 | 1 | 1 | 1 | 1 | 1 |
| | S2 | 1 | 1 | 1 | 1 | 1 | 1 | 1 | 1 | 1 | 1 |
| | S3 | 1 | 1 | 1 | 1 | 1 | 1 | 1 | 1 | 1 | 1 |
| | S4 | 1 | 1 | 1 | 1 | 1 | 1 | 1 | 1 | 0 | 1 |
| Gradation table for gradation level "244" | | 1 | 1 | 1 | 1 | 1 | 1 | 1 | 0.75 | 1 | 1 |
| Emission pattern information for gradation level "244" | S1 | 1 | 1 | 1 | 1 | 1 | 1 | 1 | 1 | 1 | 1 |
| | S2 | 1 | 1 | 1 | 1 | 1 | 1 | 1 | 1 | 1 | 1 |
| | S3 | 1 | 1 | 1 | 1 | 1 | 1 | 1 | 1 | 1 | 1 |
| | S4 | 1 | 1 | 1 | 1 | 1 | 1 | 1 | 0 | 1 | 1 |
| Gradation table for gradation level "248" | | 1 | 1 | 1 | 1 | 1 | 1 | 0.75 | 1 | 1 | 1 |
| Emission pattern information for gradation level "248" | S1 | 1 | 1 | 1 | 1 | 1 | 1 | 1 | 1 | 1 | 1 |
| | S2 | 1 | 1 | 1 | 1 | 1 | 1 | 1 | 1 | 1 | 1 |
| | S3 | 1 | 1 | 1 | 1 | 1 | 1 | 1 | 1 | 1 | 1 |
| | S4 | 1 | 1 | 1 | 1 | 1 | 1 | 0 | 1 | 1 | 1 |
| Gradation table for gradation level "251" | | 1 | 1 | 1 | 1 | 1 | 0.75 | 1 | 1 | 1 | 1 |
| Emission pattern information for gradation level "251" | S1 | 1 | 1 | 1 | 1 | 1 | 1 | 1 | 1 | 1 | 1 |
| | S2 | 1 | 1 | 1 | 1 | 1 | 1 | 1 | 1 | 1 | 1 |
| | S3 | 1 | 1 | 1 | 1 | 1 | 1 | 1 | 1 | 1 | 1 |
| | S4 | 1 | 1 | 1 | 1 | 1 | 0 | 1 | 1 | 1 | 1 |

FIG. 17A

| | |
|---|---|
| S1 | S2 |
| S3 | S4 |

FIG. 17B

| | | | | | | | |
|---|---|---|---|---|---|---|---|
| S1 | S2 | S1 | S2 | S1 | S2 | S1 | S2 |
| S3 | S4 | S3 | S4 | S3 | S4 | S3 | S4 |
| S1 | S2 | S1 | S2 | S1 | S2 | S1 | S2 |
| S3 | S4 | S3 | S4 | S3 | S4 | S3 | S4 |
| S1 | S2 | S1 | S2 | S1 | S2 | S1 | S2 |
| S3 | S4 | S3 | S4 | S3 | S4 | S3 | S4 |

FIG. 17C

| | |
|---|---|
| S2 | S3 |
| S4 | S1 |

FIG. 17D

| | | | | | | | |
|---|---|---|---|---|---|---|---|
| S2 | S3 | S2 | S3 | S2 | S3 | S2 | S3 |
| S4 | S1 | S4 | S1 | S4 | S1 | S4 | S1 |
| S2 | S3 | S2 | S3 | S2 | S3 | S2 | S3 |
| S4 | S1 | S4 | S1 | S4 | S1 | S4 | S1 |
| S2 | S3 | S2 | S3 | S2 | S3 | S2 | S3 |
| S4 | S1 | S4 | S1 | S4 | S1 | S4 | S1 |

FIG. 17E

| | |
|---|---|
| S3 | S4 |
| S1 | S2 |

FIG. 17F

| | | | | | | | |
|---|---|---|---|---|---|---|---|
| S3 | S4 | S3 | S4 | S3 | S4 | S3 | S4 |
| S1 | S2 | S1 | S2 | S1 | S2 | S1 | S2 |
| S3 | S4 | S3 | S4 | S3 | S4 | S3 | S4 |
| S1 | S2 | S1 | S2 | S1 | S2 | S1 | S2 |
| S3 | S4 | S3 | S4 | S3 | S4 | S3 | S4 |
| S1 | S2 | S1 | S2 | S1 | S2 | S1 | S2 |

FIG. 17G

| | |
|---|---|
| S4 | S1 |
| S2 | S3 |

FIG. 17H

| | | | | | | | |
|---|---|---|---|---|---|---|---|
| S4 | S1 | S4 | S1 | S4 | S1 | S4 | S1 |
| S2 | S3 | S2 | S3 | S2 | S3 | S2 | S3 |
| S4 | S1 | S4 | S1 | S4 | S1 | S4 | S1 |
| S2 | S3 | S2 | S3 | S2 | S3 | S2 | S3 |
| S4 | S1 | S4 | S1 | S4 | S1 | S4 | S1 |
| S2 | S3 | S2 | S3 | S2 | S3 | S2 | S3 |

IMAGE DISPLAY METHOD AND IMAGE DISPLAY DEVICE

This application is a U.S. National Phase Application of PCT International Application PCT/JP2004/014491.

TECHNICAL FIELD

The present invention relates to an image display method and to an image display device, which display multilevel gradation by dividing a single image field into a plurality of subfields.

BACKGROUND ART

An image display device such as a plasma display panel (hereinafter, referred to as "PDP") and a digital mirror device, that performs binary control of emission and non-emission, typically uses a subfield method to implement intermediate gradation display. The subfield method uses a plurality of subfields weighted with the number or amount of emission to divide a single field by temporal decomposition, thereby performing binary control of each pixel for each subfield. In other words, each subfield has its given brightness weight, and the sum of the brightness weights for emitting subfields determines the gradation level.

FIG. 19 illustrates an example configuration of a subfield in a PDP. In this example, a single field is divided into eight subfields (SF1, SF2, . . . , and SF8), where respective subfields have brightness weights (1, 2, 4, 8, 16, 32, 64, and 128). Each subfield is composed of initialization period T1 during which initialization discharge is performed, address period T2 during which data for emission or non-emission is written for each pixel, and sustain period T3 during which pixels with emission data being written are made to emit light all at once. Combining these subfields in various ways for emitting light allows displaying 256-level gradation "0" through "255." Gradation level "7," for example, is presented by emitting SF1, SF2, and SF3 having brightness weights 1, 2, and 4, respectively; gradation level "21," by SF1, SF3, and SF5 having brightness weights 1, 4, and 16, respectively.

In such an image display device that uses the subfield method for displaying multilevel gradation, it is known that false contour noise (hereinafter, referred to as "dynamic false contours") appears and deteriorates the image quality when displaying motion pictures. (Refer to "False Contour Noise Found in Displaying Motion Pictures by Pulse-width Modulation," The Institute of Television Engineers of Japan Technical Report, Vol. 19, No. 2, IDY95-21, pp. 61-66. (in Japanese))

Hereinafter, a description is made for the dynamic false contours. Here, a single field is also assumed to be divided into eight subfields (SF1 through SF8), respectively weighted with (1, 2, 4, 8, 16, 32, 64, and 128). As shown in FIG. 20, a case is described where image pattern X moves on the screen of PDP 33 horizontally. Image pattern X has region P1 with gradation level "127" and region P2 with "128." FIG. 21 is a view in which image pattern X is developed to subfields, where the horizontal axis corresponds to the horizontal position on the screen of PDP 33; the vertical axis, to elapsed time. Further, the hatched areas in FIG. 21 show non-emitting subfields.

When image pattern X is stationary as shown in FIG. 21, a viewer's viewpoint is also fixed to screen position A, and thus pixel-original gradation levels "127" and "128" are perceived. However, when image pattern X moves to the left, the viewpoint also moves to the direction of screen position B-B', and thus the non-emitting subfields in regions P2 and P1 are viewed. Consequently, gradation level "0", namely a dark line, is perceived. Reversely, when image pattern X moves to the right, the viewpoint also moves to the direction of screen position C-C', and thus emitting subfields in regions P1 and P2 are seen, where gradation level "255," namely a bright line, is perceived. In either case, the gradation levels are largely different from the original ("127" or "128"), and thus are perceived as contours. In this way, dynamic false contours occur where pattern information (hereinafter, referred to as "emission pattern information") that shows whether a pixel is emitted or not for each subfield largely changes, although the gradation level slightly changes. For example, if subfields weighted as above-mentioned are used, also in cases where the gradation levels of adjacent pixels are "63" and "64," "191" and "192," or the like, dynamic false contours are prominently observed, causing the image quality to deteriorate.

Under the circumstances, a method of suppressing dynamic false contours is proposed in Japanese Patent Unexamined Publication No. 2000-276100, for example. That is, convert the gradation level of an image signal to a "first gradation level" where dynamic false contours are unlikely to occur, and to its "intermediate gradation level" by means of a gradation limiting circuit, and then use an error diffusion processing circuit for diffusing an error caused by the conversion to the surrounding pixels, to interpolate skipping of gradation levels. Next, if the converted gradation level is "intermediate gradation level," round it up or down to the nearest "first gradation level." Repeat rounding-up and rounding-down alternately by pixel, by line, and by field to present averagely "intermediate gradation levels."

However, such a method has the following problems. That is, if a part where gradations have some gradient, such as an unfocused part of the image, moves at a speed visually traceable, very large dynamic false contours are observed. Inversely, attempting to suppress the dynamic false contours near a gradation level at which they occur, the number of gradation levels requires to be limited, causing image quality to deteriorate.

SUMMARY OF THE INVENTION

The present invention, in order to solve the above-mentioned problems, aims at providing an image display method and image display device that suppress dynamic false contours while securing sufficient gradation levels.

In order to solve the above-mentioned problems, the present invention provides an image display method in which a single field is composed of a plurality of subfields weighted with brightness, and plural pieces of emission pattern information, which show emission with "1" and non-emission with "0" for each subfield, are used for displaying one gradation level. The average value of gradation levels shown by each of the plural pieces of emission pattern information is equal to one gradation level. Additionally, an average emission rate, which means plural pieces of emission pattern information averaged by each subfield, of any subfield with its brightness weight smaller than the maximum brightness weight of the subfield where its average emission rate is not zero, is equal to a given threshold or greater.

BRIEF DESCRIPTION OF THE DRAWINGS

FIG. 1 shows an example of displaying gradation level "165" with four pieces of emission pattern information.

FIG. 2 shows an example of a gradation table (0 through 29) created so that an average emission rate becomes 0.75 or greater for any subfield with its brightness weight smaller than the maximum brightness weight of the subfield where its average emission rate is not zero.

FIG. 3 shows an example of the gradation table (30 through 59).

FIG. 4 shows an example of the gradation table (60 through 89).

FIG. 5 shows an example of the gradation table (90 through 119).

FIG. 6 shows an example of the gradation table (120 through 149).

FIG. 7 shows an example of the gradation table (150 through 179).

FIG. 8 shows an example of the gradation table (180 through 209).

FIG. 9 shows an example of the gradation table (210 through 239).

FIG. 10 shows an example of the gradation table (240 through 255).

FIG. 11A shows an arrangement of a virtual matrix with two lines by two pixels.

FIG. 11B shows a state in which a screen is paved with pixels.

FIG. 13 shows an emitted state "1" or a non-emitted state "0" and average emission rates in each subfield for four pieces of emission pattern information when displaying the gradation levels "240," "244," "248," and "251."

FIG. 17A shows an arrangement of a virtual matrix with two lines by two pixels.

FIG. 17B shows a state in which a screen is paved with pixels.

FIG. 17C shows an arrangement of a virtual matrix with two lines by two pixels.

FIG. 17D shows a state in which a screen is paved with pixels.

FIG. 17E shows an arrangement of a virtual matrix with two lines by two pixels.

FIG. 17F shows a state in which a screen is paved with pixels.

FIG. 17G shows an arrangement of a virtual matrix with two lines by two pixels.

FIG. 17H shows a state in which a screen is paved with pixels.

REFERENCE MARKS IN THE DRAWINGS

Figure 12:
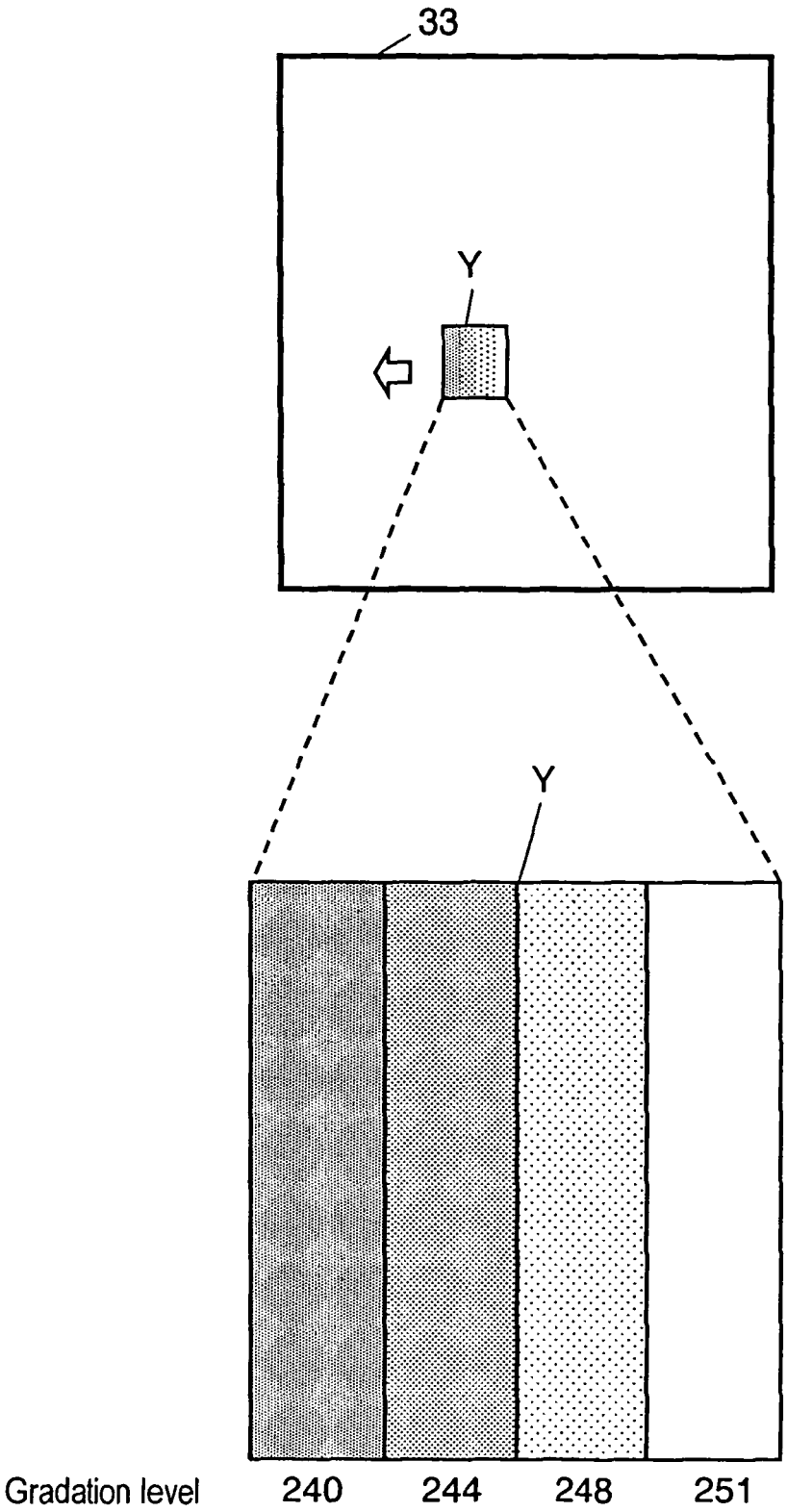
FIG. 12 illustrates a motion picture gradient region.

1: Image display device
11: Analog-digital (A/D) converter
13: Inverse gamma correction circuit
17: Emission pattern information generation circuit
19: Dither generation circuit
27: Subfield processing circuit
29: Scanning/sustain/erasing driver
31: Data driver
33: Plasma display panel (PDP)
35: Timing pulse generation circuit
201, 202, 203, 204: Look-up table
401, 402, 403, 404: Emission pattern information selector
410, 411, 420: Selector

DETAILED DESCRIPTION OF PREFERRED EMBODIMENT

Exemplary Embodiment

First, a description is made for a concept of how to reduce dynamic false contours according to the present invention. Here, a description is made for a case where a single field is divided into ten subfields (SF1, SF2, . . . and, SF10), and brightness weights of each subfield are 1, 2, 4, 8, 12, 16, 28, 44, 60, and 80, respectively, as an example.

As mentioned above, dynamic false contours occur where emission pattern information largely changes, although the gradation level slightly changes. Therefore, if an image is displayed only with such gradation levels that all subfields having brightness weight smaller than that of subfields to be emitted, are emitted, change in the emission pattern information becomes small, thus preventing dynamic false contours from occurring.

Gradation levels satisfying this condition are specifically eleven gradation levels: (0, 1, 3, 7, 15, 27, 43, 71, 115, 175, and 255). Gradation level "27," for example, satisfies this condition because all the subfields having brightness weight of SF5 or smaller emit, and those of SF6 or larger do not emit. Displaying an image only with such eleven gradation levels prevents dynamic false contours from occurring. However, attempting to display an image only with at most eleven gradation levels results in insufficient gradation levels, thus deteriorating the image quality.

Under the circumstances, in the image display method according to the present invention, plural pieces of emission pattern information are used for displaying one gradation level to increase the number of gradation levels. In addition, the number of gradation levels with which all the subfields having brightness weight smaller than that of a falsely emitted subfield emit, is increased to reduce dynamic false contours.

The conditions of plural pieces of emission pattern information used in the image display method related to the present invention are as follows: (1) The average value of the gradation levels shown by each of plural pieces of emission pattern information is to be equal to one gradation level to be displayed. (2) It is assumed that emission pattern information shows emission with "1" and non-emission with "0" for each subfield, and that plural pieces of emission pattern information averaged for each subfield is an average emission rate. In this case, an arrangement is made so that an average emission rate becomes 0.75 or greater for any subfield with its brightness weight smaller than the maximum brightness weight of the subfield where its average emission rate is not zero.

FIG. 1 shows an example for displaying gradation level "165" with four pieces of emission pattern information. Four pieces of emission pattern information S1 through S4 are not necessarily required to be different one another. For example, emission pattern information S1 and S2 in FIG. 1 are identical. The gradation levels shown by the emission pattern information S1, S2, S3, and S4 are 175, 175, 147, and 163, respectively. The average value of them is equal to "165," namely the gradation level to be displayed, thus satisfying the above condition (1).

In the same way, the followings show that the example in FIG. 1 satisfies the above condition (2). In FIG. 1, the values of three pieces of emission pattern information S1, S2, S3 are "1" for SF5, and the value of remaining emission pattern information S4 is "0" for SF5, which results in an average emission rate of "0.75" for SF5. In the same way, the values of three pieces of emission pattern information S1, S2, S4 are "1" for SF7, and the value of remaining emission pattern information S3 is "0" for SF7, which results in an average emission rate of "0.75" for SF7. In this case, even if the value of any one piece out of four pieces of emission pattern information S1 through S4 is "0" for a subfield, the average emission rate of the subfield remains "0.75" or greater.

In such a way, in the example of FIG. 1, an average emission rate becomes 0.75 or greater for any subfield with its brightness weight smaller than the maximum brightness weight of the subfield where its average emission rate is not zero, which satisfies the above condition (2).

Here, a combination of plural pieces of emission pattern information satisfying the above conditions (1) and (2) is not limited to the example of FIG. 1, but other combinations can be created.

FIGS. 2 through 10 show an example of a gradation table created so that an average emission rate becomes "0.75" or greater for all the gradation levels. Each gradation level is set so that an average emission rate becomes "0.75" or "1" for any subfield with its brightness weight smaller than the maximum brightness weight of the subfield where its average emission rate is not zero. In FIGS. 2 through 10, all the gradation levels are displayed by using plural pieces of emission pattern information while satisfying the above conditions (1) and (2).

There are two methods that use four pieces of emission pattern information S1 through S4. One is a time-averaging process, in which emission pattern information is changed timewise for one pixel. The other is a space-averaging process, in which emission pattern information is arranged spatially for a plurality of pixels adjacent to one another.

In the method of displaying a given gradation level by means of a time-averaging process, four pieces of emission pattern information S1 through S4 are changed for each single field. Consequently, if emission is made three times per four fields in a subfield for one pixel (namely, 0.75 emissions per one field time-averagely), for example, the average emission rate of four pieces of emission pattern information S1 through S4 is "0.75" in the subfield.

Next, FIG. 11 shows an example of displaying a given gradation level by means of a space-averaging process. The entire screen is paved, as shown in FIG. 11B, with an arrangement of the matrix with two lines by two pixels (four pixels A1 through A4) shown in FIG. 11A. Consequently, if, in the matrix focused, three pixels out of four (e.g. A1 through A3) are in an emitted state "1", and the remaining one pixel (e.g. A4) is in a non-emitted state "0" in a subfield, the average emission rate of four pieces of emission pattern information S1 through S4 becomes "0.75" in the subfield.

In this way, performing a time-averaging process and/or space-averaging process for these four pieces of emission pattern information S1 through S4 allows displaying gradation levels satisfying the above conditions (1) and (2).

Next, a description is made for workings in which a gradation level displayed with the image display method according to the present invention becomes a gradation level with which all the subfields having brightness weight smaller than that of a falsely emitted subfield, emit.

Here, as shown in FIG. 12, a description is made for a region (hereinafter, referred to as "motion picture gradient region") in which image pattern Y moves that has gradation levels with some level of gradient and some size of its area. Image pattern Y is assumed to be displayed in four regions with their gradation levels "240," "244," "248," and "251," respectively, for example. Further, each gradation level is assumed to be displayed with a combination of four pieces of emission pattern information S1 through S4, based on the gradation table shown in FIGS. 2 through 10.

FIG. 13 shows an example for an emitted state "1" and a non-emitted state "0" of four pieces of emission pattern information S1 through S4, in each subfield, and average emission rates, when displaying gradation levels "240," "244," "248," and "251."

Figure 14:
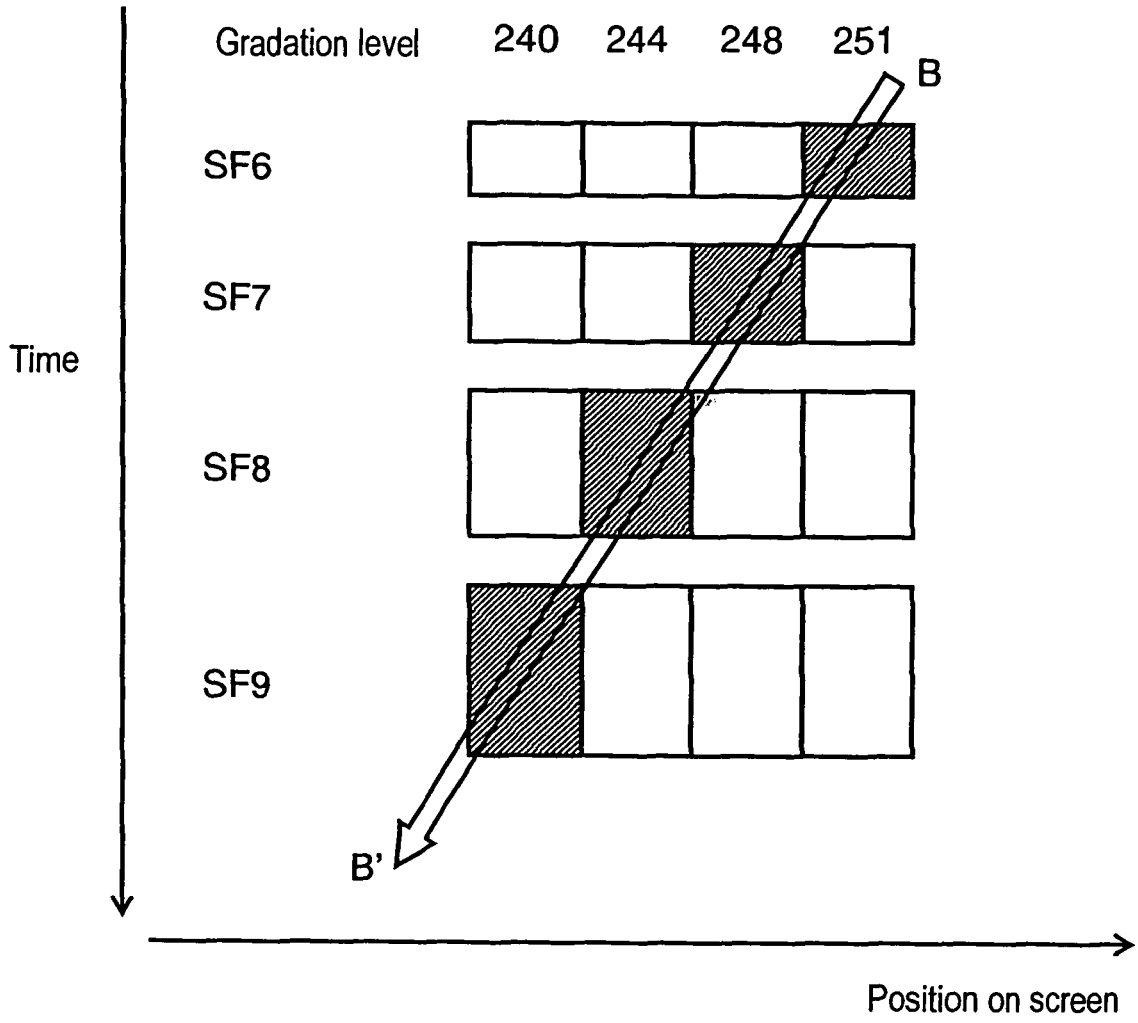
FIG. 14 illustrates a motion picture gradient region developed into subfields.

FIG. 14 illustrates image pattern Y developed into subfields, where the lateral direction corresponds to the horizontal direction on the screen of PDP 33, and the vertical direction to elapsed time. The hatched areas in FIG. 14 show that the average emission rate is "0.75".

Here, if all the subfields shown by the hatched areas in FIG. 14 become a non-emitted state "0", and such a state remains for a given time, the viewpoint moves in the direction B-B' on the screen, resulting in following the four subfields with a non-emitted state "0". This causes dynamic false contours to be perceived as a dark dark line.

However, it is only when emission pattern information S4 is simultaneously selected for all the four gradation levels "240," "244," "248," and "251" that all the hatched subfields become a non-emitted state "0". Even if only a time-averaging process is performed for the emission pattern information, it is only in a period of a single field out of four that all the hatched subfields become a non-emitted state "0". Still, even if all the hatched subfields become a non-emitted state "0" during such a short period, dynamic false contours are not visually perceived.

Moreover, performing a space-averaging process for the emission pattern information prevents the same emission pattern information from being selected for adjacent pixels. Therefore, even if the change in emission pattern information by the unit of one pixel meets the condition in which dynamic false contours occur, the change is not visually perceived because it is very small.

From all of the above, as a result that a time-averaging process and space-averaging process are performed for four pieces of emission pattern information S1 through S4 available from the gradation table created as shown by FIGS. 2 through 10, the number of gradation levels with which all the subfields having brightness weight smaller than that of a falsely emitted subfield emit can be increased, suppressing dynamic false contours.

Here, the gradation table shown by FIGS. 2 through 10 is one example, and other gradation tables satisfying the above conditions (1) and (2) can be created. Meanwhile, in the gradation table shown by FIGS. 2 through 10, each gradation level is set so that an average emission rate becomes "0.75" or greater for any subfield with its brightness weight smaller than the maximum brightness weight of the subfield where its average emission rate is not zero. However, an experiment shows that very few dynamic false contours occur that practically cause the image quality to deteriorate, as long as this average emission rate is 0.5 or greater.

Figure 15:
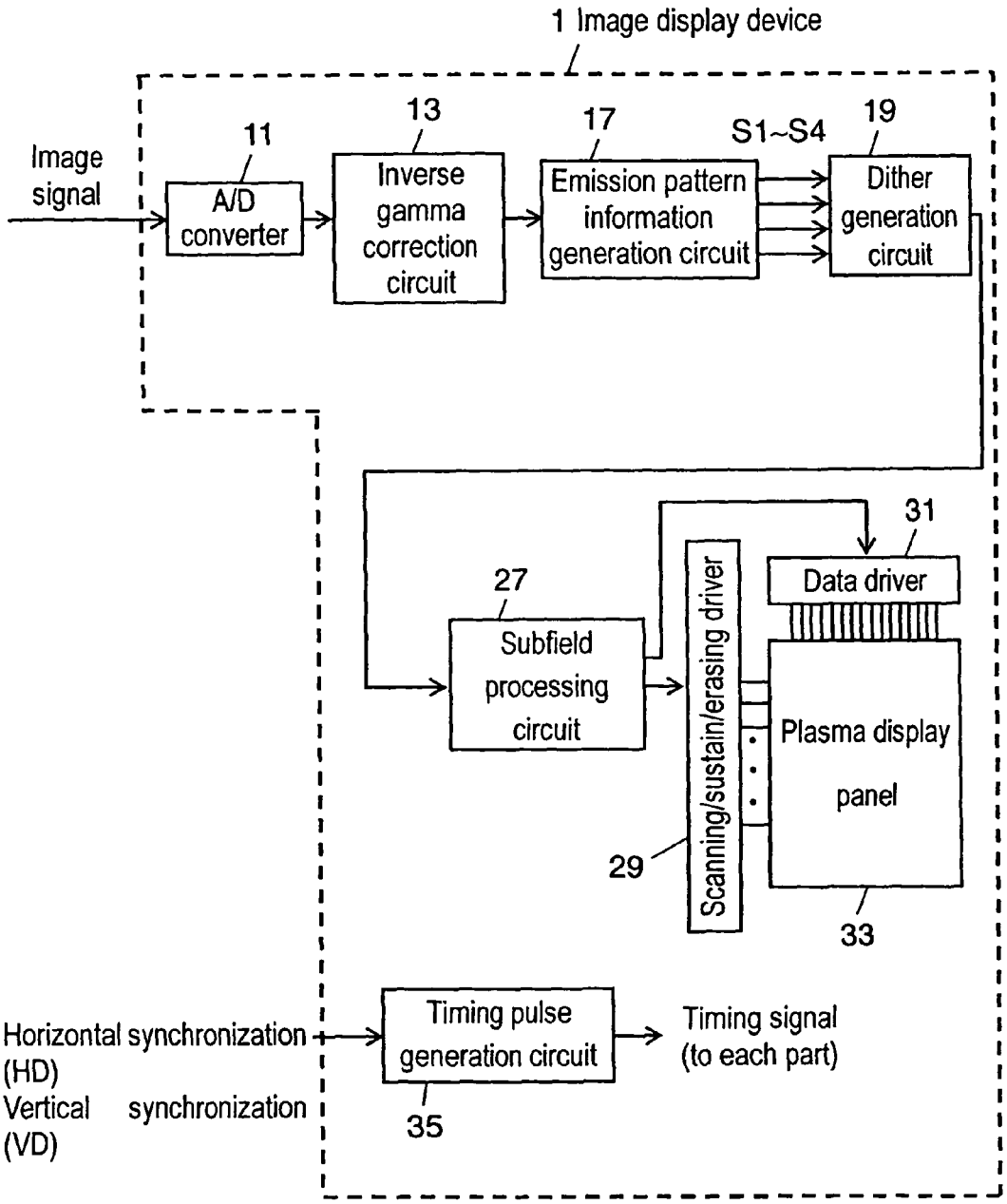
FIG. 15 is a block circuit diagram of an image display device according to the embodiment of the present invention.

Next, a description is made for the makeup and actions according to the embodiment of the present invention, referring to drawings. FIG. 15 is a block circuit diagram of image display device 1 according to the embodiment of the present invention. In FIG. 15, analog-digital (A/D) converter 11 performs A/D conversion of image signals. Inverse gamma correction circuit 13 performs inverse gamma correction of image signals A/D-converted. Image signals that have undergone inverse gamma correction is sent to emission pattern information generation circuit 17. Emission pattern information generation circuit 17 converts the gradation level of an image signal having been sent, to four pieces of emission pattern information S1 through S4. The four pieces of emission pattern information S1 through S4 converted by emission pattern information generation circuit 17 are input to dither generation circuit 19. Dither generation circuit 19 performs a time-averaging process and a space-averaging process for the four pieces of emission pattern information S1 through S4, and selects one out of the four pieces of emission pattern information S1 through S4. A detailed description is hereinafter made for emission pattern information generation circuit 17 and dither generation circuit 19, as they are principal parts of the present invention. Subfield processing circuit 27 determines the number of sustain pulses being output during a sustain period, based on the emission pattern information being output from dither generation circuit 19. Scanning/sustain/erasing driver 29 and data driver 31 control emission/non-emission of each pixel, based on output from subfield processing circuit 27, to display an image with an intended gradation level on PDP 33. Timing pulse generation circuit 35 generates various timing signals, based on the horizontal synchronizing signal and vertical synchronizing signal, to supply each part in image display device 1 with the timing signals.

Figure 16:
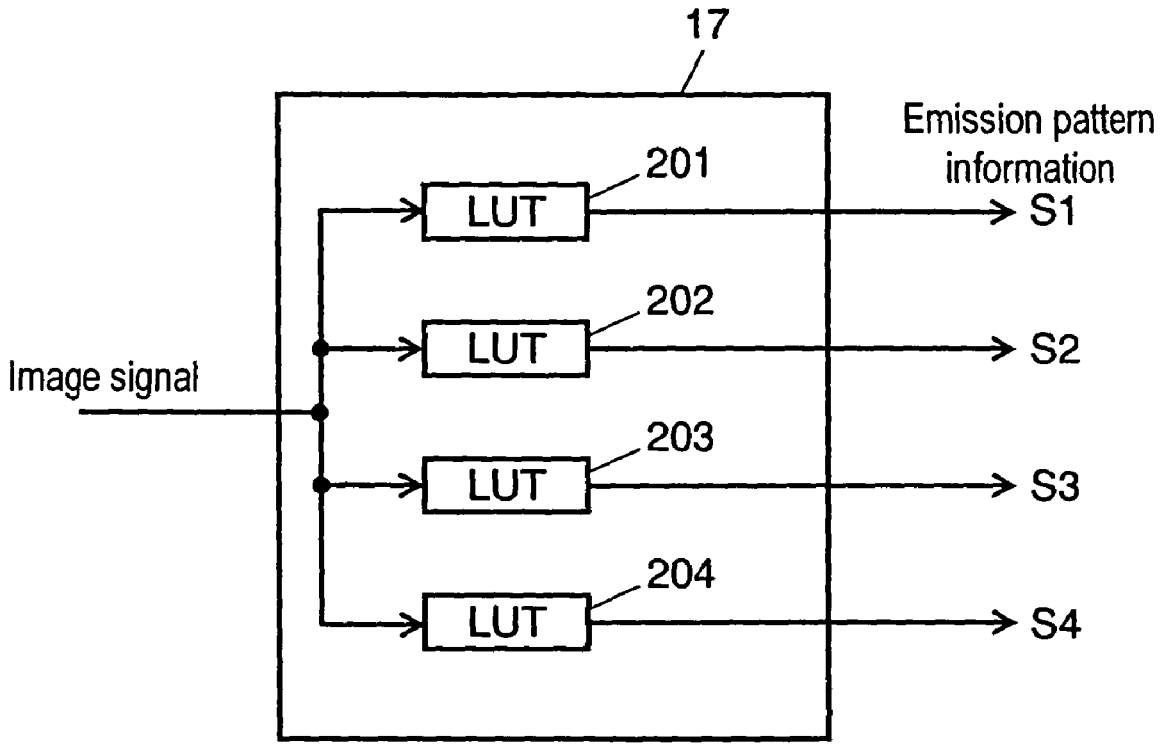
FIG. 16 illustrates an example of the internal configuration for an emission pattern information generation circuit.

Next, a description is made for emission pattern information generation circuit 17 according to the embodiment of the present invention. FIG. 16 is an example internal configuration of emission pattern information generation circuit 17. In FIG. 16, emission pattern information generation circuit 17 is composed of four look-up tables LUTs 201 through 204. Image signals from inverse gamma correction circuit 13 are commonly input to LUTs 201 through 204. Emission pattern information S1 through S4 for all the gradation levels are preliminarily set to the four look-up tables LUTs 201 through 204, and four-pieces of emission pattern information S1 through S4 are simultaneously output that correspond to the gradation level for an image signal to be input.

For example, if an image signal having gradation level "165" in FIG. 1 is input to emission pattern information generation circuit 17, emission pattern information S1=(1, 1, 1, 1, 1, 1, 1, 1, 1, 0) is output from LUT 201. Here, the values "1" and "0" in the parentheses show an emitted state "1" or a non-emitted state "0" of each subfield in sequence from the left. In the same way, emission pattern information S2=(1, 1, 1, 1, 1, 1, 1, 1, 1, 0) is output from LUT 202; S3=(1, 1, 1, 1, 1, 1, 0, 1, 1, 0) from LUT 203; and S4=(1, 1, 1, 1, 0, 1, 1, 1, 1, 0) from LUT 204.

If an image signal having another gradation level is input to emission pattern information generation circuit 17, four pieces of emission pattern information S1 through S4 are simultaneously output in the same way as mentioned above.

Next, a description is made for dither generation circuit 19 according to the embodiment of the present invention. FIGS. 17A through 17H show the entire screens paved with virtual matrices with two lines by two pixels. In FIGS. 17A through 17H, S1 through S4 show one piece of emission pattern information for displaying a gradation level for a corresponding pixel. Paving the entire screen with a matrix as shown by FIG. 17A results in a matrix as shown by FIG. 17B. In the same way, paving the entire screen with a matrix as shown by FIG. 17C, 17E, or 17G, results in a matrix as shown by FIG. 17D, 17F, or 17H, respectively. Then, as a result that these four kinds of virtual matrices with two lines by two pixels are changed in the sequence of FIG. 17A, FIG. 17C, FIG. 17E, and FIG. 17G, for each field, a time-average value and a space-average value are achieved of gradation levels displayed with a combination of four pieces of emission pattern information S1 through S4.

Figure 18:
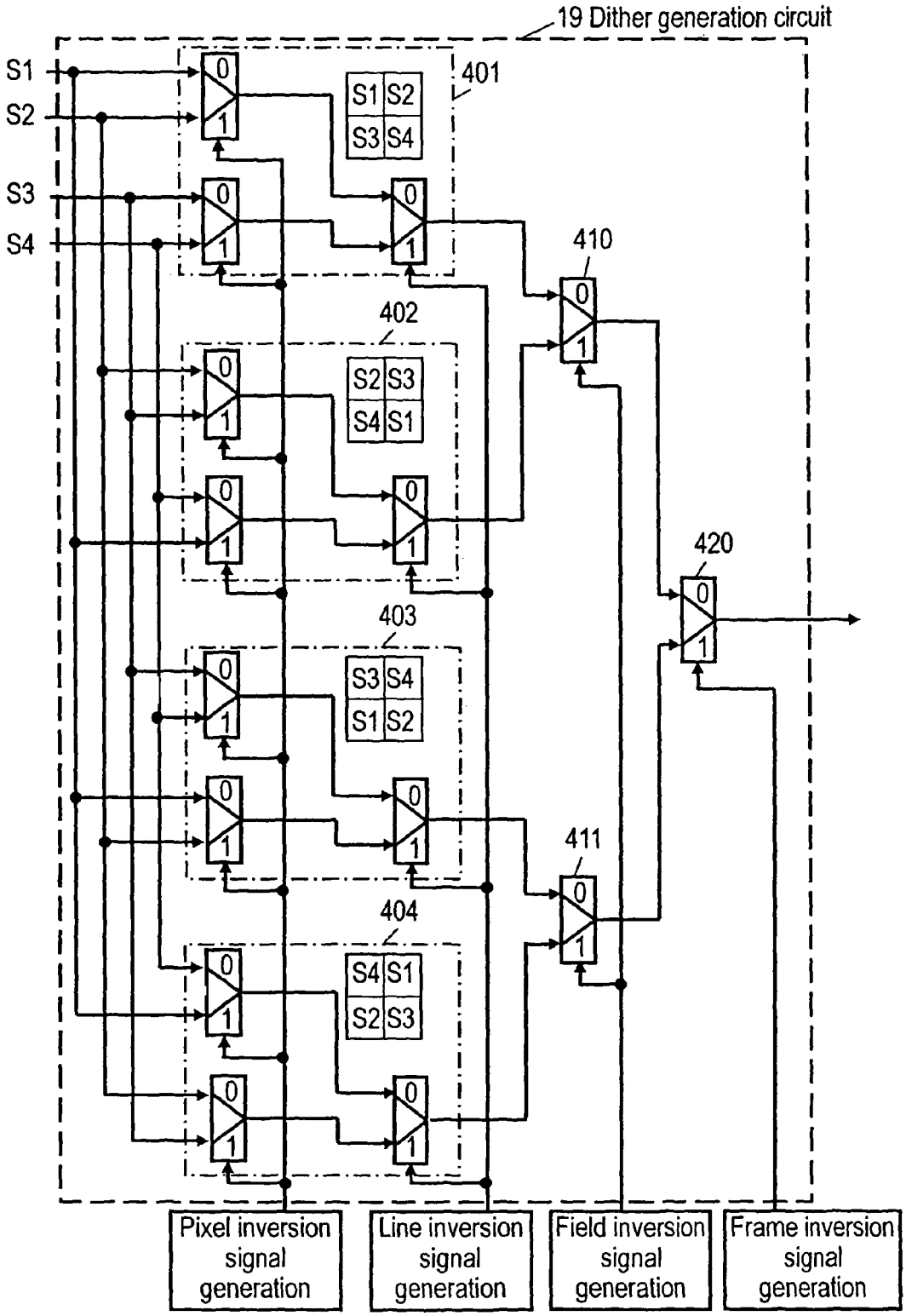
FIG. 18 illustrates an example of the internal configuration for a dither generation circuit according to the embodiment.
Figure 19:
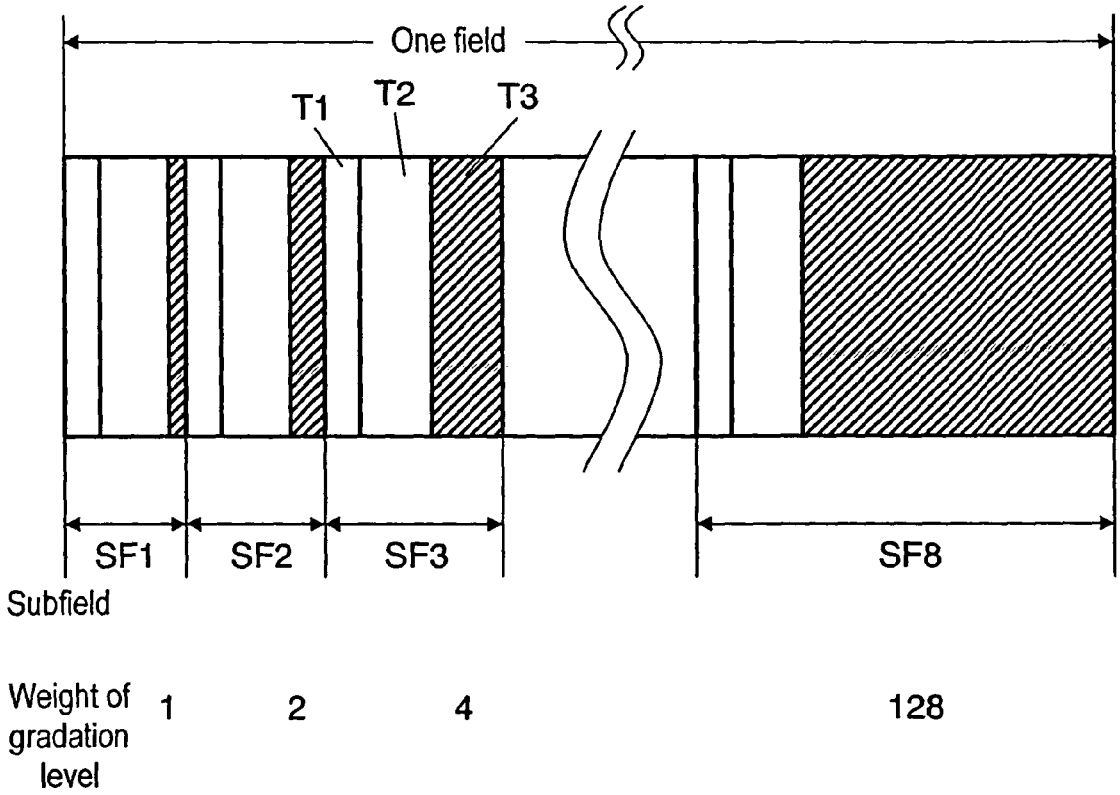
FIG. 19 illustrates an example of the configuration of subfields in a conventional PDP.
Figure 20:
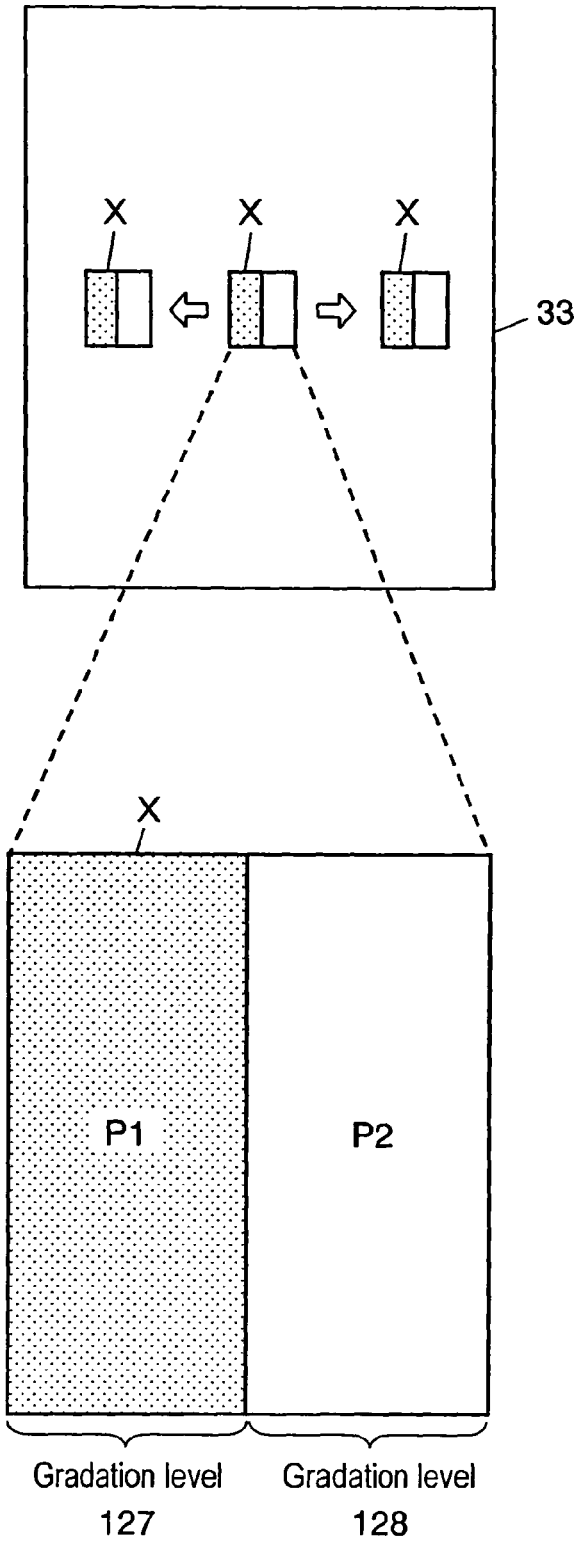
FIG. 20 illustrates a pattern with which dynamic false contours occur.
Figure 21:
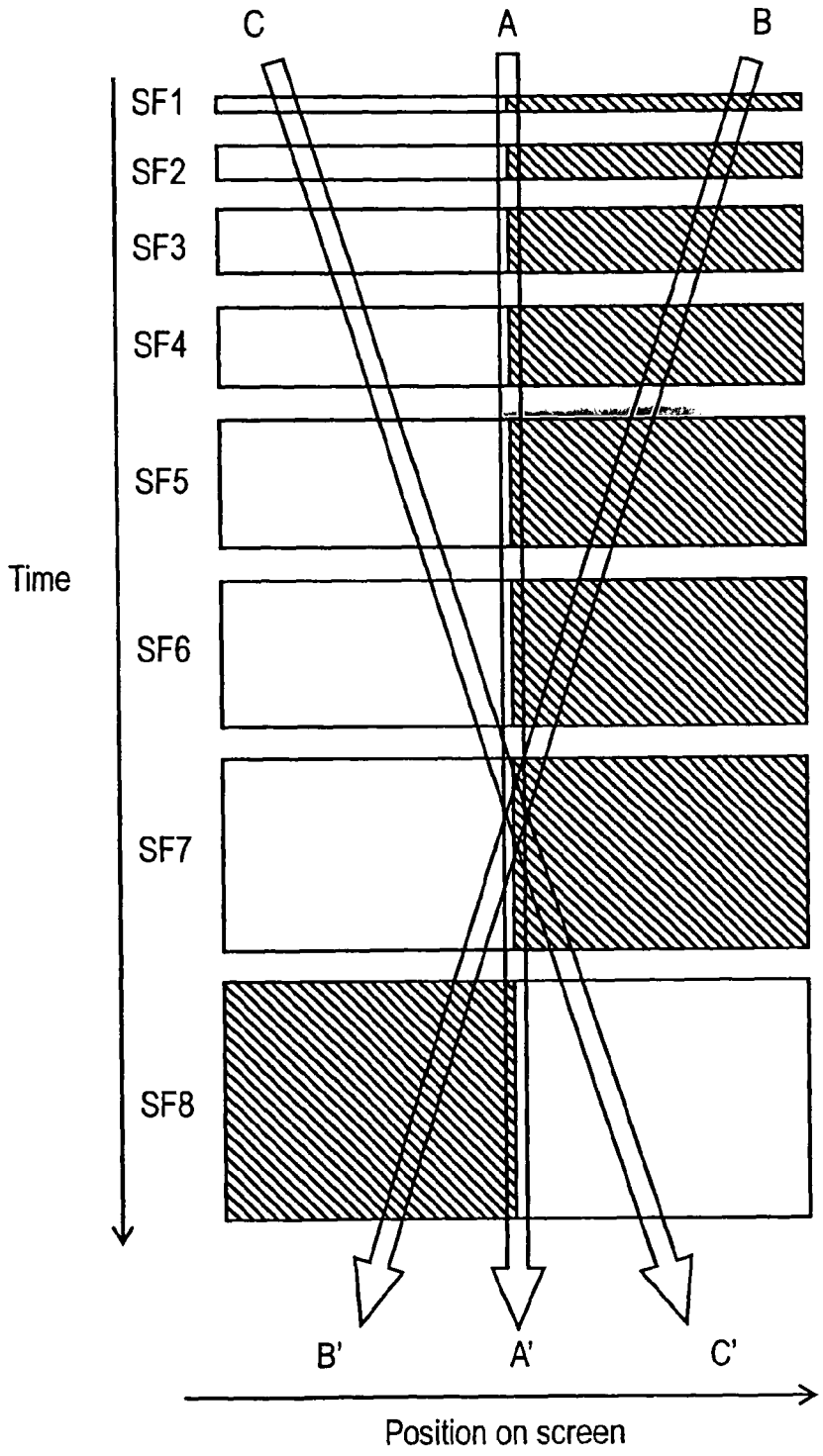
FIG. 21 illustrates the cause why dynamic false contours occur.

FIG. 18 illustrates an example internal configuration of dither generation circuit 19 according to the embodiment of the present invention. The four emission pattern information selectors 401, 402, 403, and 404, shown in FIG. 18 select the four pieces of emission pattern information S1 through S4 as appropriate, by means of a pixel inversion signal inverting by pixel, and of a line inversion signal inverting by line. In this case, emission pattern information selector 401 selects the pattern information so that the matrix with two lines by two pixels is arranged as shown in FIG. 17A. In the same way, emission pattern information selectors 402, 403, or 404 selects the pattern information so that the matrix with two lines by two pixels is arranged as shown in FIG. 17C, FIG. 17E, or FIG. 17G, respectively. Next, selector 410 uses a field inversion signal inverting by field, to alternately select and output the matrix of FIG. 17A or FIG. 17C, for each field. In the same way, selector 411 alternately selects and outputs the matrix of FIG. 17E or FIG. 17G, for each field. Further, selector 420 uses a frame inversion signal inverting by frame, to select output of selector 410 or selector 411.

Consequently, dither generation circuit 19 selects the matrix of FIG. 17A for the first field and paves the entire screen with it as in FIG. 17B, to output emission pattern information corresponding to each pixel. Further, for the subsequent field, the circuit selects the matrix of FIG. 17C and paves the entire screen with it as in FIG. 17D, to output emission pattern information corresponding to each pixel. Still, for the third and fourth fields, the circuit selects the matrix of FIG. 17E or FIG. 17G, and paves the entire screen with it as in FIG. 17F or FIG. 17H, respectively, to output emission pattern information corresponding to each pixel.

In this way, dither generation circuit 19 selects a matrix in a cycle of four fields timewise and spatially, to perform a dither process. Additionally, all gradation levels can be displayed in any region regardless of whether it is a motion picture gradient region or not, and thus dispensing with a gradation level limiting circuit and an error diffusion processing circuit, with which an image is displayed conventionally using only gradation levels resistant to generating dynamic false contours.

As mentioned above, using an image display device according to the embodiment of the present invention allows suppressing dynamic false contours while securing sufficient gradation levels.

INDUSTRIAL APPLICABILITY

The present invention provides an image display method and image display device that allow suppressing dynamic false contours while securing sufficient gradation levels, and thus useful for an image display method, image display device, and others in which a single image field is divided into a plurality of subfields for multilevel gradation display.

The invention claimed is:

1. A method of displaying an image in a display screen by displaying a gradation level for each pixel, the method comprising the steps of:

forming a subfield group that includes a plurality of subfields each weighted with a brightness weight in a field;

forming an emission pattern information, which is a combination of binary values, that indicates an emitted state by a value of "1" or a non-emitted state by a value of "0" corresponding to every subfield in the subfield group, forming each of gradation levels to be displayed using predetermined plural pieces of emission pattern information;

making an average value of each of the gradation levels to be displayed using the predetermined pieces of emission pattern information be equal to one of the gradation levels to be displayed; and making an average emission rate for every subfield to be defined by averaging the binary values corresponding to each, of the same subfield; and wherein the predetermined pieces of emission pattern information are preliminarily set for each of the gradation levels to be displayed so that the average emission rate of any subfield with a brightness weight smaller than a maximum brightness weight is equal to or greater than 0.75 among the subfields where the average emission rate is not zero.

2. A method of displaying an image as claimed in claim 1, wherein a given level of gradation is displayed by timewise changing each of the plurality of pieces of emission pattern information, for one pixel.

3. A method of displaying an image as claimed in claim 2, wherein a given level of gradation is displayed by spatially arranging each of the plurality of pieces of emission pattern information, for a plurality of adjacent pixels.

4. A method of displaying an image as claimed in claim 1, wherein a given level of gradation is displayed by spatially arranging each of the plurality of pieces of emission pattern information, for a plurality of adjacent pixels.

5. A method of displaying an image as claimed in claim 1, wherein a number of the predetermined plural pieces is 4.

6. A method of displaying an image as claimed in claim 1, wherein a number of the gradation levels is 256.

7. A device for displaying an image in a display screen by displaying a gradation for each pixel, wherein:

a subfield group including a plurality of subfields each weighted with a brightness weight is formed in a field, and an emission pattern information, which is a combination of binary values, that indicates an emitted state by a value of "1" or a non-emitted state by a value of "0" corresponding to every subfield is formed in the subfield group, and wherein the device a controller that:

forms each of gradation levels to be displayed using predetermined plural pieces of emission pattern information;

makes an average value of each of the gradation levels to be displayed using predetermined pieces of emission pattern information equal to one of the gradation levels to be displayed; and makes an average emission rate for every subfield to be defined by averaging the binary values corresponding to each of the same subfield; and makes the predetermined pieces of emission pattern information preliminarily set for each of the gradation levels to be displayed so that the average emission rate of any subfield with the brightness weight smaller than a maximum brightness weight equal to or greater than 0.75 among the subfields where the average emission rate is not zero.

8. A device for displaying an image as claimed in claim 7, wherein a given level of gradation is displayed by timewise changing each of the plurality of pieces of emission pattern information, for one pixel.

9. A device of displaying an image as claimed in claim 8, wherein a given level of gradation is displayed by spatially arranging each of the plurality of pieces of emission pattern information, for a plurality of adjacent pixels.

10. A device of displaying an image as claimed in claim 7, wherein a given level of gradation is displayed by spatially arranging each of the plurality of pieces of emission pattern information, for a plurality of adjacent pixels.

11. A device for displaying an image as claimed in claim 7, wherein a number of the predetermined plural pieces is 4.

12. A device for displaying an image as claimed in claim 7, wherein a number of the gradation levels is 256.

* * * * *